US007503469B2

(12) United States Patent
Bloom et al.

(10) Patent No.: US 7,503,469 B2
(45) Date of Patent: Mar. 17, 2009

(54) INTEGRALLY MOLDED DISPENSING VALVE AND METHOD OF MANUFACTURE

(75) Inventors: Kenneth S. Bloom, Bloomdale, OH (US); Brian J. Brozell, Maumee, OH (US); Darin M. Pugne, Perrysburg, OH (US); Wendell D. Willingham, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 554 days.

(21) Appl. No.: 11/076,376

(22) Filed: Mar. 9, 2005

(65) Prior Publication Data

US 2006/0201976 A1 Sep. 14, 2006

(51) Int. Cl.
*B65D 5/72* (2006.01)

(52) U.S. Cl. ..... 222/494; 222/212

(58) Field of Classification Search ..... 222/490–497, 222/80–82, 212, 213, 546, 541.9; 215/11.1, 215/346, 347; 606/234
See application file for complete search history.

(56) References Cited

U.S. PATENT DOCUMENTS

| | | | | |
|---|---|---|---|---|
| 3,241,726 | A | 3/1966 | Chester | |
| 4,749,108 | A | 6/1988 | Dornsbusch et al. | |
| 4,991,745 | A | 2/1991 | Brown | |
| 5,115,950 | A | 5/1992 | Rohr | |
| 5,213,236 | A | 5/1993 | Brown et al. | |
| 5,271,531 | A | 12/1993 | Rohr et al. | |
| 5,339,995 | A | 8/1994 | Brown et al. | |
| 5,409,144 | A | 4/1995 | Brown | |
| 5,439,143 | A | 8/1995 | Brown et al. | |
| 5,632,420 | A | 5/1997 | Lohrman et al. | |
| 5,743,443 | A * | 4/1998 | Hins | 222/490 |
| 5,769,253 | A | 6/1998 | Gross | |
| 5,788,108 | A | 8/1998 | Rohr | |
| 5,839,614 | A | 11/1998 | Brown | |
| 5,842,618 | A | 12/1998 | Julemont et al. | |
| 5,868,273 | A * | 2/1999 | Daenen et al. | 220/795 |
| 5,897,033 | A | 4/1999 | Okawa et al. | |
| 5,927,566 | A | 7/1999 | Mueller | |
| 5,927,567 | A | 7/1999 | Fillmore | |
| 5,971,232 | A | 10/1999 | Rohr et al. | |

(Continued)

FOREIGN PATENT DOCUMENTS

| | | |
|---|---|---|
| EP | 0082757 | 6/1983 |

(Continued)

OTHER PUBLICATIONS

U.S. Statury Invention Registration Reg. No. H2027 Published: Jun. 4, 2002 Inventors: Paul E. Brown et al. (14pgs).

*Primary Examiner*—Lien T Ngo
(74) *Attorney, Agent, or Firm*—Reising Ethington P.C.

(57) ABSTRACT

A dispensing valve includes an annular ring of relatively rigid molded plastic construction and a flexible resilient valve element integrally molded with the ring. The ring and the valve element have at least one mechanical interlock to secure the valve element to the ring as the valve element is molded onto the ring. In some embodiments of the disclosure, the mechanical interlock includes openings in an inner periphery of the ring and pegs on the outer periphery of the valve element that are molded into the openings as the valve element is molded onto the ring.

19 Claims, 7 Drawing Sheets

U.S. PATENT DOCUMENTS

| | | | | |
|---|---|---|---|---|
| 6,003,698 | A * | 12/1999 | Morano | 215/11.1 |
| 6,065,642 | A | 5/2000 | Brown | |
| 6,079,594 | A | 6/2000 | Brown et al. | |
| 6,089,411 | A | 7/2000 | Baudin et al. | |
| 6,095,381 | A | 8/2000 | Schwanenberg | |
| 6,112,951 | A | 9/2000 | Mueller | |
| 6,230,940 | B1 | 5/2001 | Manning et al. | |
| 6,273,296 | B1 | 8/2001 | Brown | |
| 6,273,305 | B1 | 8/2001 | Fioravanti et al. | |
| 6,290,108 | B1 | 9/2001 | Gross | |
| 6,293,437 | B1 | 9/2001 | Socier et al. | |
| 6,305,563 | B1 | 10/2001 | Elliot | |
| 6,367,668 | B1 | 4/2002 | Schwanenberg | |
| 6,405,901 | B1 | 6/2002 | Schantz et al. | |
| 6,427,874 | B2 | 8/2002 | Brown et al. | |
| 6,446,844 | B1 | 9/2002 | Gross | |
| 6,450,375 | B1 | 9/2002 | Hins et al. | |
| 6,530,504 | B2 | 3/2003 | Socier | |
| 6,557,721 | B2 * | 5/2003 | Yang | 220/713 |
| 6,672,487 | B1 | 1/2004 | Lohrman | |
| 6,749,092 | B2 | 6/2004 | Olechowski et al. | |
| 7,032,783 | B1 * | 4/2006 | Kamp et al. | 222/321.9 |
| 7,097,790 | B2 * | 8/2006 | Jochem | 264/40.4 |
| 7,299,952 | B2 * | 11/2007 | Stull et al. | 222/212 |
| 2001/0025862 | A1 | 10/2001 | Brown et al. | |
| 2002/0096540 | A1 | 7/2002 | Gross et al. | |
| 2002/0134801 | A1 | 9/2002 | Stewart | |
| 2002/0162839 | A1 | 11/2002 | Stull et al. | |
| 2003/0057237 | A1 | 3/2003 | Stull et al. | |
| 2003/0189067 | A1 | 10/2003 | Stull et al. | |
| 2004/0040987 | A1 | 3/2004 | Ramsey et al. | |
| 2006/0037975 | A1 * | 2/2006 | Suffa | 222/490 |

FOREIGN PATENT DOCUMENTS

| | | |
|---|---|---|
| EP | 0395380 | 10/1990 |
| EP | 0442379 | 8/1991 |
| EP | 0586778 | 3/1994 |

* cited by examiner

INTEGRALLY MOLDED DISPENSING VALVE AND METHOD OF MANUFACTURE

The present disclosure relates to dispensing closures for fluid products such as beverages, food condiments and body lotions, and more particularly to a dispensing valve and method of manufacture for such closures.

BACKGROUND AND SUMMARY OF THE INVENTIONS

U.S. Pat. No. 6,672,487 discloses a fluid dispensing closure and a package that includes a container having a body for holding a product to be dispensed and a finish having an open mouth. A dispensing closure is mounted on the container finish. In one embodiment, the dispensing closure includes a base and a lid integrally hinged to the base. The base has a deck with a dispensing opening. A flexible resilient dispensing valve is mounted within the dispensing opening by a separate retaining ring secured to the deck surrounding the dispensing opening. A general object of the present disclosure is to provide a dispensing valve, a dispensing closure embodying a dispensing valve, and a method of making a dispensing valve, in which the dispensing valve element is integrally molded to the valve mounting ring structure to facilitate handling of the valve after molding and automated assembly of the valve/mounting ring to the dispensing closure shell or other support structure.

The present disclosure embodies a number of aspects or inventions, which can be implemented separately from or in combination with each other.

A dispensing valve in accordance with one aspect of the present disclosure includes an annular ring of relatively rigid molded plastic construction and a flexible resilient valve element integrally molded with the ring. The ring and the valve element have at least one mechanical interlock to secure the valve element to the ring as the valve element is molded onto the ring. In some embodiments of the disclosure, the mechanical interlock includes through-openings in an inner periphery of the annular ring and pegs on the outer periphery of the valve element that are molded into the through-openings as the valve element is molded onto the annular ring.

A dispensing valve in accordance with another aspect of the present disclosure includes an annular ring of relatively rigid molding plastic construction having an outer periphery for securing the valve within a dispensing opening and an inner periphery in the form of an annular ledge having an angularly spaced array of openings. A flexible resilient valve element is molded onto the ring so as to have an outer peripheral portion engaged with the ledge of the ring and integral pegs that extend into the openings on the ring to lock the valve element to the ring. Each of the openings in the mounting ring preferably is a through-opening that includes an enlarged portion opening at one axially facing surface of the ring ledge, and an ensmalled portion aligned with the enlarged portion and opening at a second axially facing surface of the ledge. The valve element preferably includes an annular flange in opposed engagement with the second axially facing surface of the ring ledge, and pegs integrally molded with the flat annular flange extending through the ensmalled portions of the through-openings into the enlarged portions of the openings.

A dispensing valve in accordance with a further aspect of the disclosure is of one-piece integrally molded construction that includes a ring of relatively rigid thermoplastic or thermosetting resin construction and a flexible resilient valve element of thermoplastic or thermosetting resin construction.

The ring and the valve preferably are sequentially molded, and the ring preferably is of a material having a higher melt or higher softening temperature than that of the valve element. The valve element preferably is of silicone composition and the ring preferably is of nylon composition.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
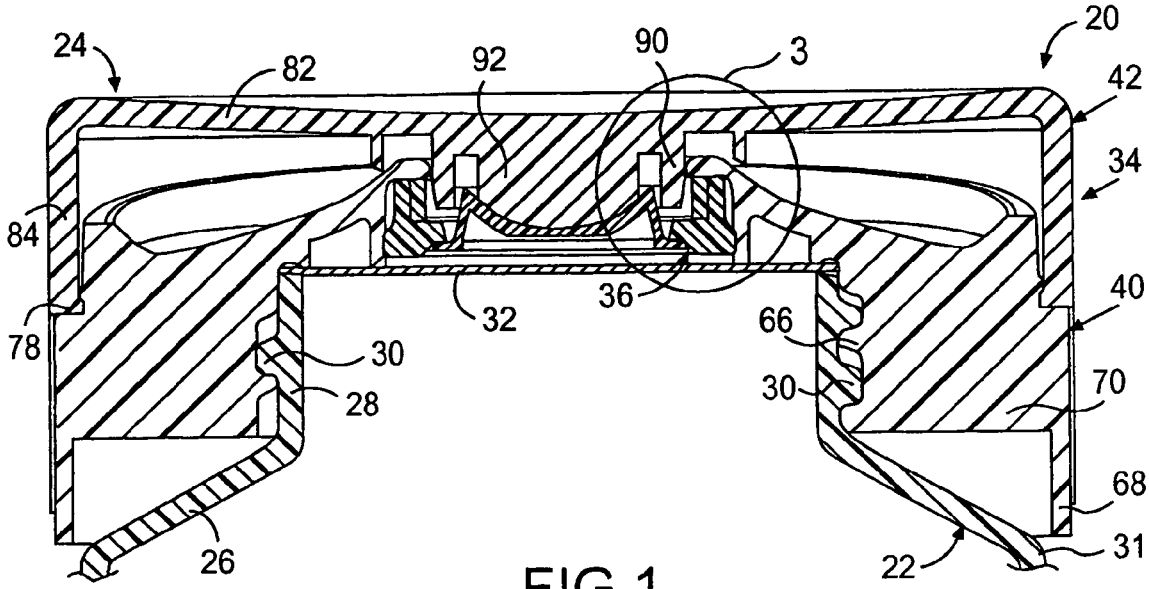
FIG. 1 is a fragmentary sectional view of a package that includes a dispensing closure with dispensing valve in accordance with one embodiment of the present disclosure.

FIG. 1 illustrates a dispensing package 20 in accordance with one presently preferred embodiment of the disclosure as including a container 22 to which a dispensing closure 24 is secured. Container 22 has a body 26 and a cylindrical neck finish 28 with one or more external securement features, such as external threads or thread segments 30. Container 22 preferably is of molded plastic construction, having a flexible resilient sidewall 31 that may be squeezed by a user for dispensing product from within the package. A film seal 32 may be secured over the open end of neck finish 28 so as to close the mouth of the finish after product has been placed in the package. Film seal 32 is to be removed by a user prior to dispensing product.

Dispensing closure 24 in the illustrated embodiment of the disclosure is a two-piece assembly that includes a shell 34 to which a dispensing valve 36 is secured. Shell 34 preferably is of one-piece integrally molded plastic construction, as shown in FIGS. 4-10. Shell 34 includes a base 40 to which a lid 42 is pivotally secured by a hinge 44. Hinge 44 in the illustrated embodiment of the disclosure comprises a pair of laterally spaced hinge elements 46,48 that together form a snap hinge of the type illustrated in U.S. Pat. Nos. 5,794,308 and 6,041,477. However, the disclosure is by no means limited to snap hinges of this type, and other hinge arrangements can be employed.

Figure 5:
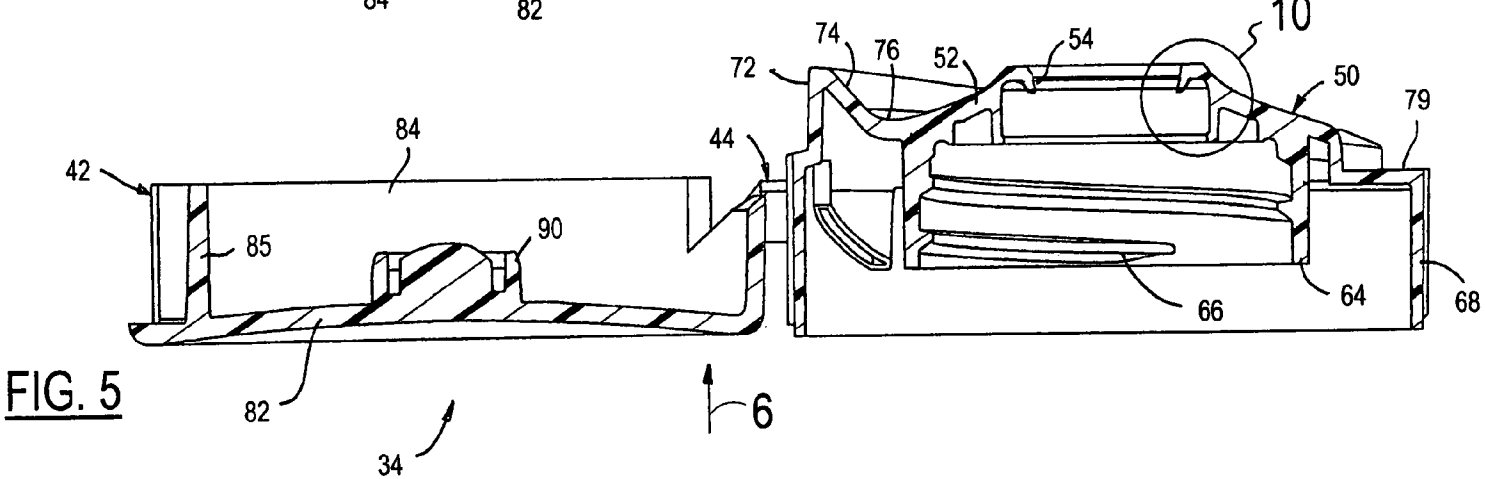
FIG. 5 is a sectional view taken substantially along the line 5-5 in FIG. 4.
Figure 6:
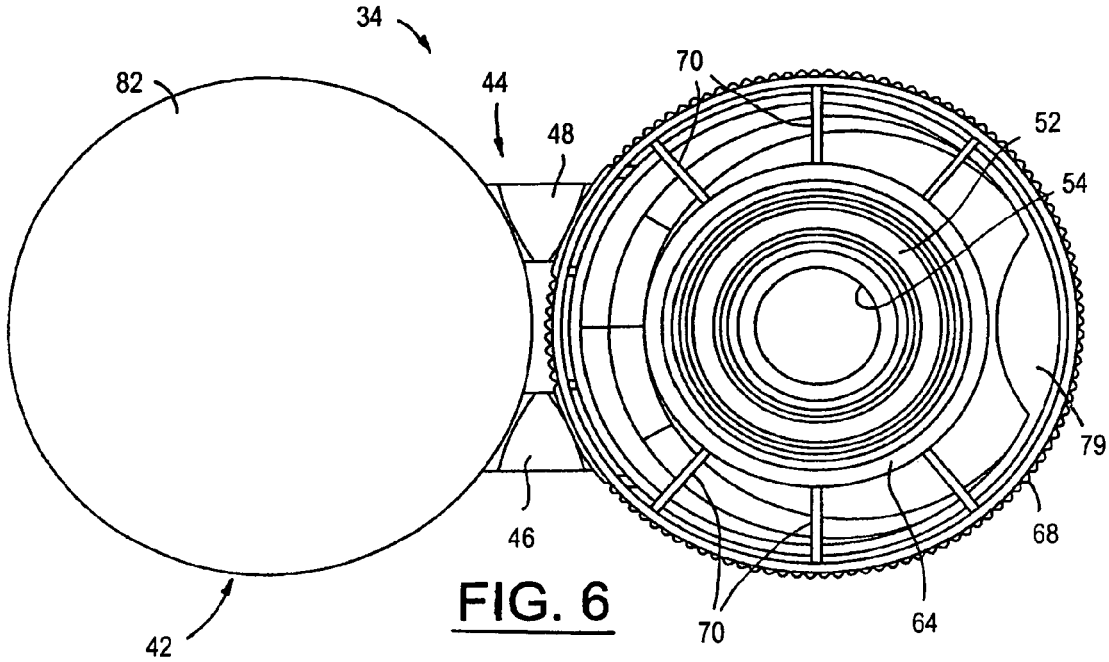
FIG. 6 is a bottom plan view of the closure shell in FIGS. 4 and 5.
Figure 10:
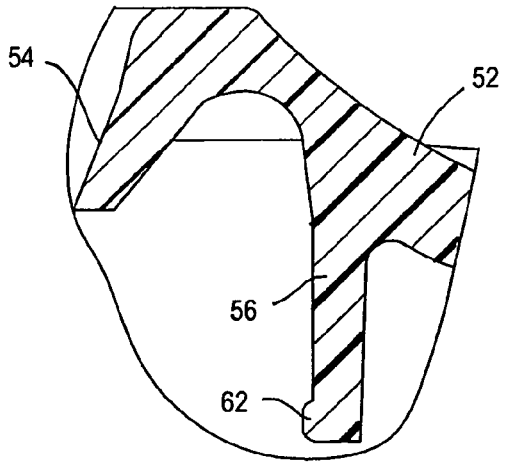
FIG. 10 is a fragmentary sectional view on an enlarged scale of the portion of FIG. 5 within the area 10.
Figure 11:
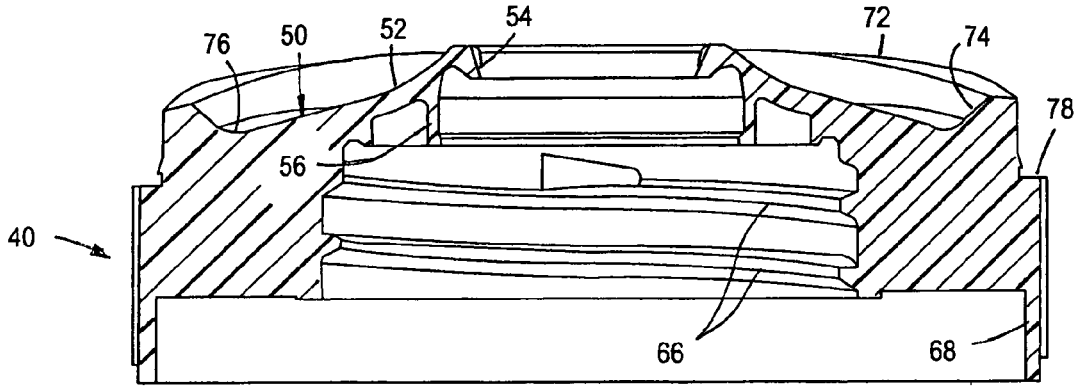
FIG. 11 is a sectional view taken substantially along the line 11-11 in FIG. 4.

Base 40 includes a central deck 50. The central portion 52 of deck 50 may be of domed, such as generally conical, construction. A dispensing opening 54 is positioned in deck central portion 52, preferably centrally positioned. As best seen in FIGS. 5 and 10, an annular wall 56 extends axially from an undersurface of deck central portion 52 surrounding and coaxial with dispensing opening 54. A radially inwardly extending internal bead 62 may be provided on annular wall 56, and may be either circumferentially continuous or segmented. The exemplary embodiment of the disclosure illustrated in the drawings includes an internal skirt 64 with internal attachment means, such as threads or thread segments 66, for securing the closure to a container finish, and an external skirt 68 that extends from the periphery of deck 50. External skirt 68 may be of a geometry to match the geometry of the associated container, such as cylindrical in the embodiment illustrated in the drawings. A circumferential array of radially and axially extending ribs 70 interconnect skirts 64, 68 for strengthening and rigidifying closure shell base 40. Single wall closure shells also can be employed.

Figure 7:
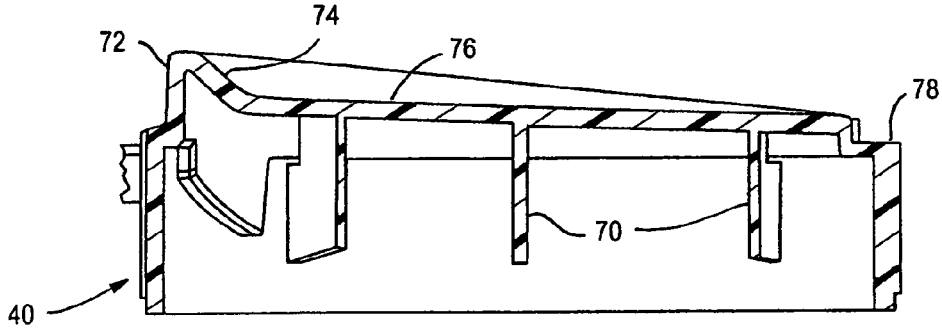
FIGS. 7, 8 and 9 are fragmentary sectional views taken substantially along the respective lines 7-7, 8-8 and 9-9 in FIG. 4.
Figure 8:
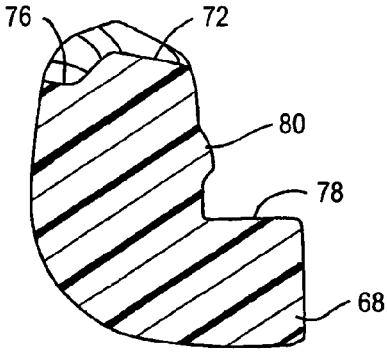
Figure 9:
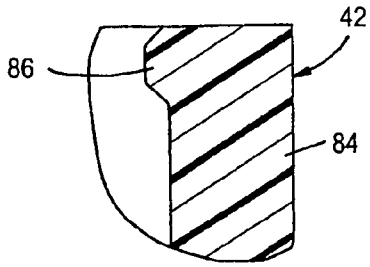

Deck 50 in the exemplary closure includes a raised wall 72 that partially surrounds the central portion 52 of the deck. Raised wall 72 has a greatest axial height adjacent to hinge 44, and decreases in height symmetrically in both directions around the periphery of central portion 52, preferably to zero height at a position diametrically spaced from hinge 44. The decreasing height of wall 72 is best seen in FIGS. 5 and 7. Wall 72 has a radially inner surface 74 that blends with central portion 52 of deck 50 to form a concave channel 76 surrounding central portion 52. (Directional words such as "upper" and "lower" are employed by way of description and not limitation with respect to the upright orientation of the closure illustrated in FIGS. 1, 3 and 5, for example. Directional words such as "inner" and "outer" are employed by way of description and not limitation with respect to the axis of the closure or finish, as appropriate.) As best seen in FIGS. 5 and 7, channel 76 has a concave upper surface, the base or bottom of which lies in a plane that is angled with respect to the axis of the dispensing opening and with respect to the peripheral portion of deck 50. The upper surface of channel 76 has a radius of curvature that is smallest adjacent to hinge 44, and increases symmetrically around central deck portion 52 to being substantially flat diametrically opposite the hinge.

The peripheral portion of deck 50 also includes a ledge 78 that is axially recessed with respect to domed central portion 52. Ledge 78 extends entirely around central portion 52 in a plane that preferably is perpendicular to the axis of base 40. A radially outwardly extending circumferential bead 80 extends at least part way around deck 50 axially adjacent to but spaced from ledge 78. Ledge 78 is enlarged at 79 diametrically opposite hinge 44.

Figure 2:
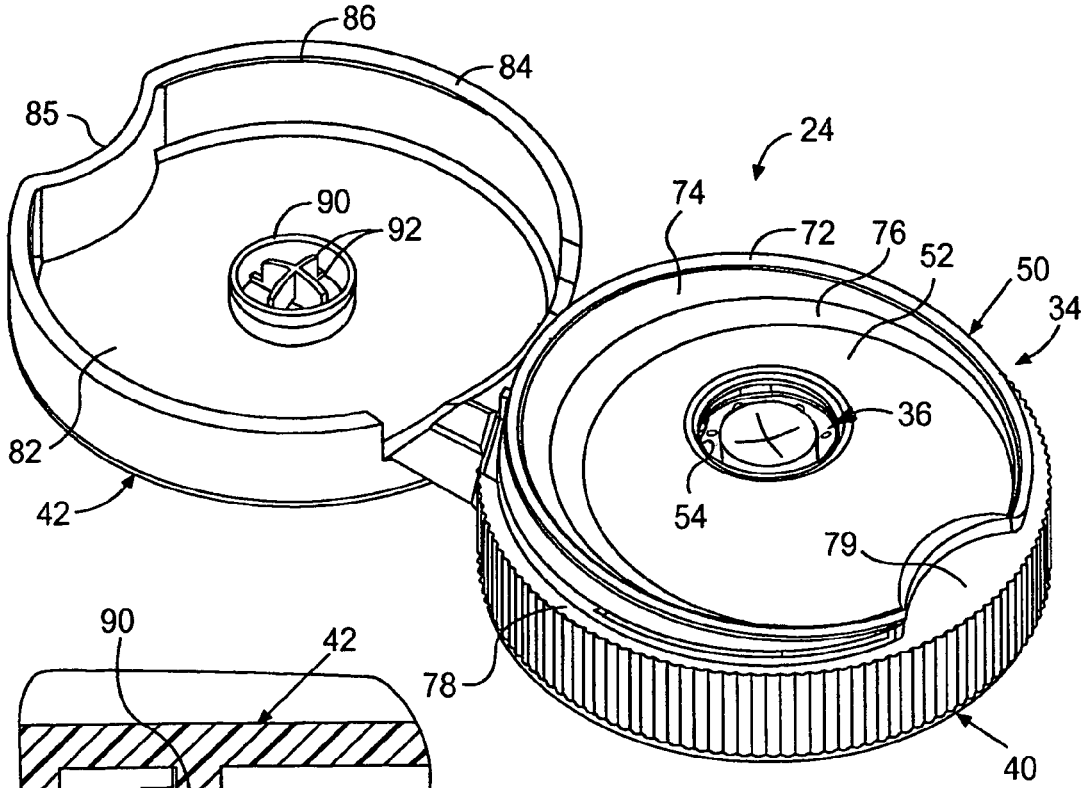
FIG. 2 is a perspective view of the dispensing closure in the package of FIG. 1.
Figure 3:
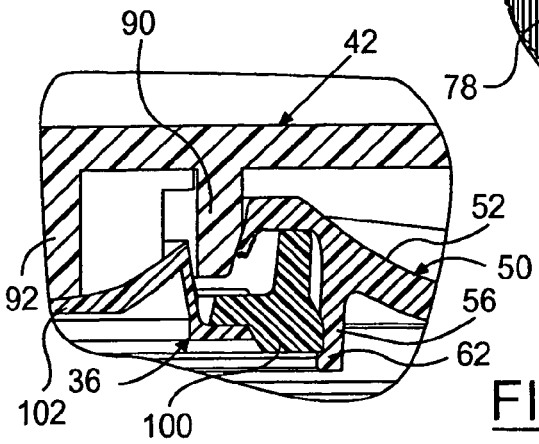
FIG. 3 is a fragmentary sectional view of the portion of FIG. 1 within the area 3.
Figure 4:
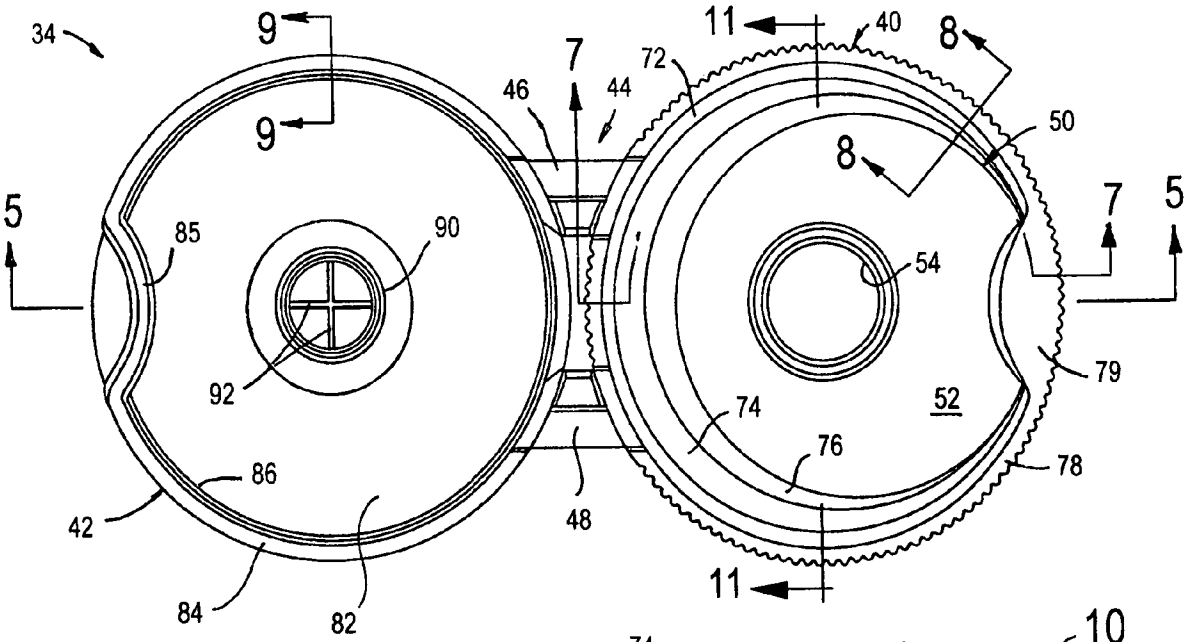
FIG. 4 is a top plan view of the dispensing closure shell in the embodiment of FIGS. 1-3.

Lid 42 includes a base wall 82 and a peripheral skirt 84. The edge of skirt 84 remote from base wall 82 preferably lies in a plane, and is adapted for edge engagement with ledge 78 on base 40 in the closed position of the lid (FIG. 1). An internal bead 86 (FIGS. 4 and 9) preferably extends at least part way around lid skirt 84 for snap-receipt over bead 80 (FIG. 8) to hold the lid in the closed position. An annular bead 90 on lid base wall 82 is received between valve 36 and the inner periphery of dispensing opening 54 in the closed position of the lid, as shown in FIGS. 1 and 3. Crossed walls 92 within bead 90 are disposed adjacent to valve 36 in the closed position of the lid, as shown in FIGS. 1 and 3. Walls 92 and bead 90 help prevent valve 36 from opening when the lid is closed, thereby preventing undesired leakage of product from within the package. Skirt 84 is indented at 85 (FIGS. 2, 4 and 5), and base wall 82 extends over this indent. Ledge enlargement 79 and indent 85 form a thumb tab for opening of the closure lid. To the extent thus far described, closure 24 is similar to that disclosed in U.S. application Ser. No. 10/874,036, the disclosure of which is incorporated herein by reference.

Figure 12:
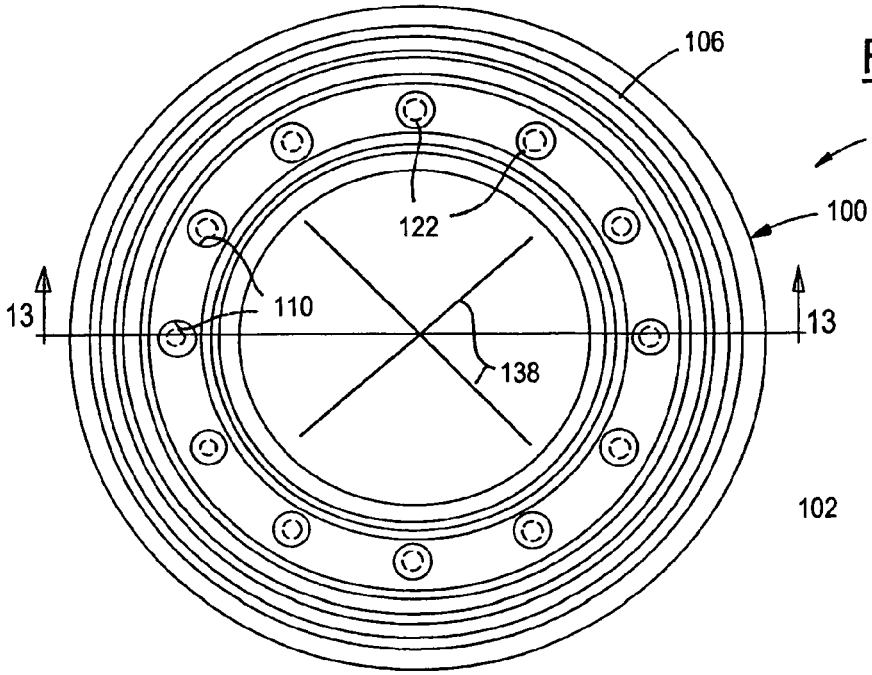
FIG. 12 is a top plan view of the dispensing valve in the closure of FIGS. 1-3.
Figure 13:
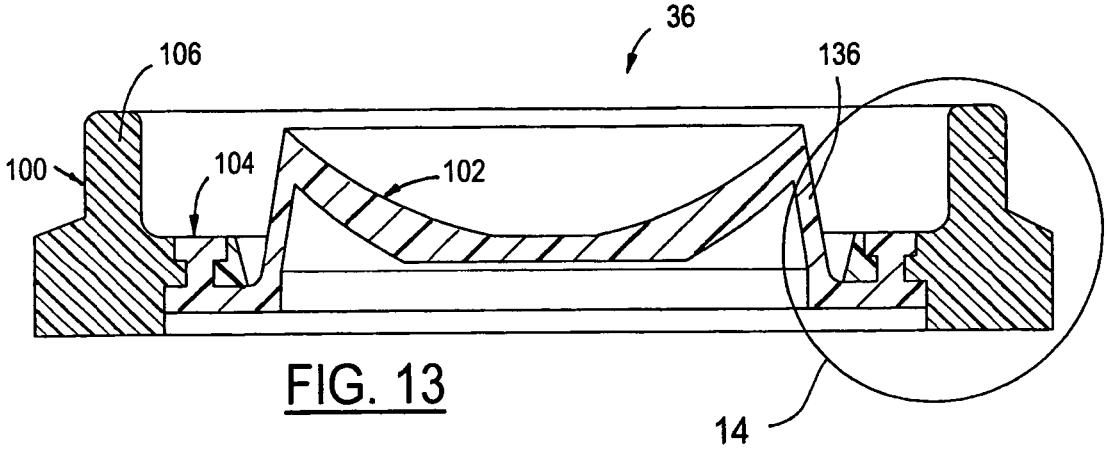
FIG. 13 is a sectional view taken substantially along the line 13-13 in FIG. 12.
Figure 14:
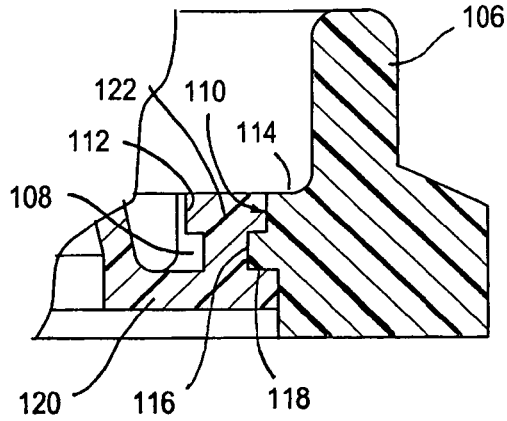
FIG. 14 is a fragmentary sectional view on an enlarged scale of the portion of FIG. 13 within the area 14.

Dispensing valve 36 is shown in detail in FIGS. 12-14. Valve 36 includes a mounting ring 100 to which a valve element 102 is integrally molded. Valve mounting ring 100 is of relatively rigid plastic construction, while valve 102 is flexible and resilient. In one presently preferred embodiment of the disclosure, valve element 102 is of liquid silicon rubber (LSR) construction. Valve mounting ring 100 in this example is of a plastic, such as nylon, suitable to withstand the relatively high cure temperature of LSR. However, in accordance with one aspect of the present disclosure, valve element 102 is coupled to mounting ring 100 by at least one mechanical interlock 104, so that the materials of the dispensing valve and the mounting ring are not necessarily (although they could be) chemically compatible so as to form a chemical bond between the dispensing valve and the mounting ring during the valve-molding operation.

Mounting ring 100 includes an outer periphery formed by an annular wall 106 with suitable structure for mounting valve 36 within the dispensing closure shell. A ledge 108 extends radially inwardly from wall 106. Ledge 108 preferably is flat and perpendicular to the central axis of wall 106. A plurality of openings 110 extend into ledge 108 in an angularly spaced array round the axis of the dispensing closure. Openings 110 preferably are identical, and preferably are through-openings that include an enlarged portion 112 that opens at one axially facing surface 114 of ledge 108, and an aligned but relatively ensmalled portion 116 that opens at an opposing axially facing surface 118 of wall 108. Valve element 102 as molded has a flat annular radially outwardly extending flange portion 120 with a circumferential array of axially extending pegs 122 that extend through ensmalled portions 116 of openings 110 into enlarged portions 112. Flange portion 120 is in facing engagement with axially facing surface 118 of ledge 108, so that pegs 122 extend through ensmalled portions 116 and into enlarged portions 112 of openings 1110, thereby mechanically locking valve 102 to mounting ring 100 entirely around the periphery of the valve. Valve element 102 in the illustrated embodiment includes a central portion 136 integral with flange 120. Central portion 136 includes one or more slits 138 (FIG. 12) for dispensing product. The illustrated geometry of central portion 136 is exemplary only and does not relate directly to the subject matter of the present disclosure.

Figure 15:
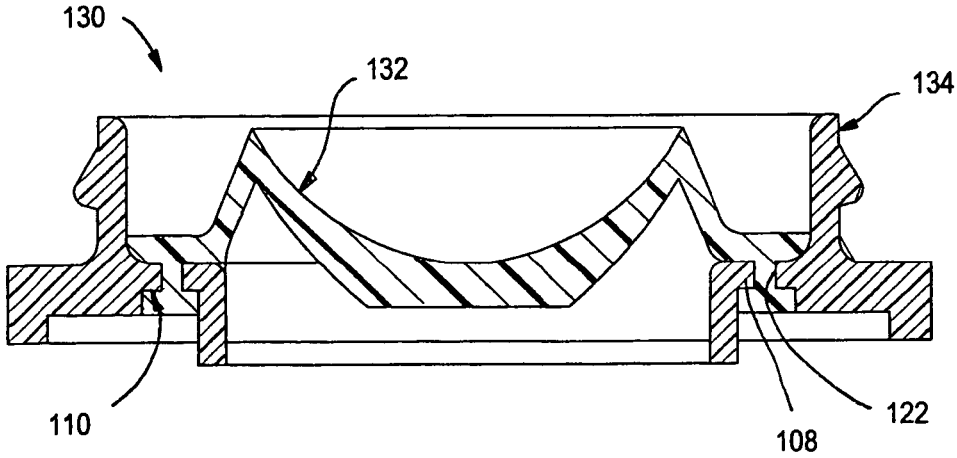
FIG. 15 is a sectional view that is similar to that of FIG. 13 but illustrates a modified embodiment of a dispensing valve in accordance with the present disclosure.

FIG. 15 illustrates a dispensing valve 130, which is similar to that of FIGS. 12-14 but in which the valve element 132 is molded to the upper surface rather than to the lower face or undersurface of mounting ring 134. Otherwise, dispensing valve 130 in FIG. 15 is similar to valve 36 of FIGS. 12-14, and identical reference numerals are employed to indicate identical or corresponding elements.

Figure 16:
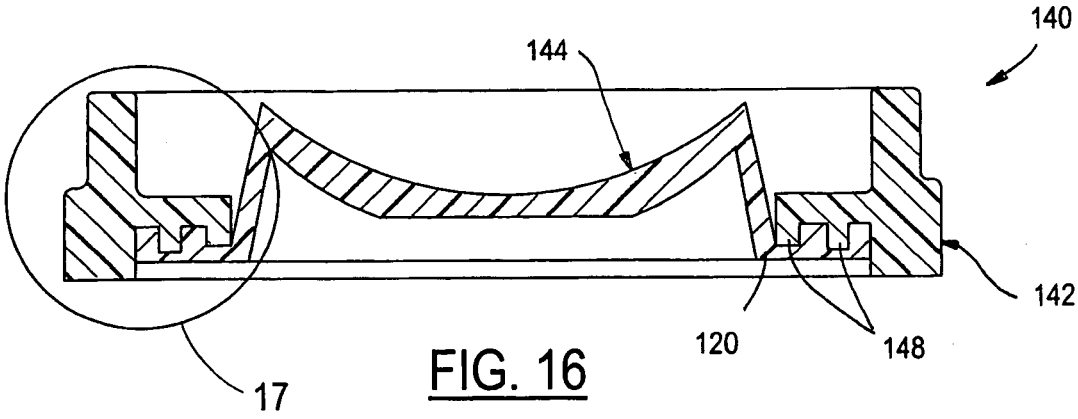
FIG. 16 is a sectional view of another embodiment of the disclosure.
Figure 17:
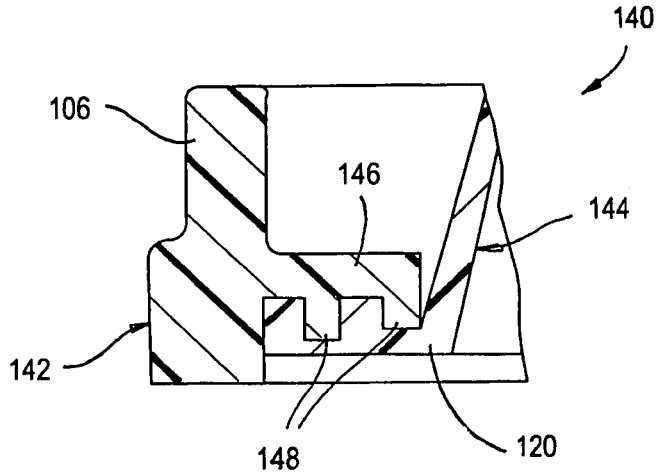
FIG. 17 is an enlargement of the portion of FIG. 16 within the area 17.

FIGS. 16-17 illustrate a dispensing valve 140 that includes a mounting ring 142 and a valve element 144 molded onto the mounting ring. Mounting ring 142 has an inwardly extending ledge 146, which preferably is flat and perpendicular to the axis of the mounting ring. One surface of ledge 146, preferably the undersurface, has a plurality of projections 148. These projections preferably comprise at least one annular wall or rib, and more preferably a pair of annular walls or ribs. The ribs may be circumferentially continuous or discontinuous. The ribs preferably are concentric with each other and with the axis of ring 142. As an alternative to ribs, one or more arrays of pegs can be employed, and the pegs may have rivet-like heads spaced from ledge 146. When valve element 144 is molded onto mounting ring 142, projections 148 become embedded in flange 120 and hold the valve element in place.

Figure 18:
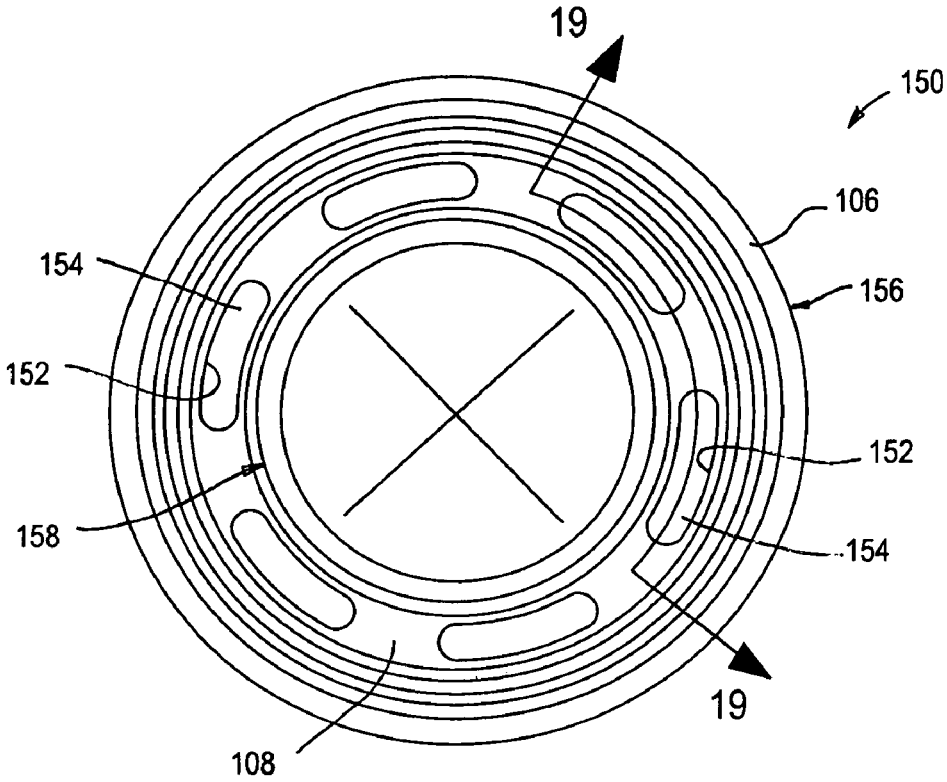
FIG. 18 is a sectional view of a further embodiment of the disclosure.
Figure 19:
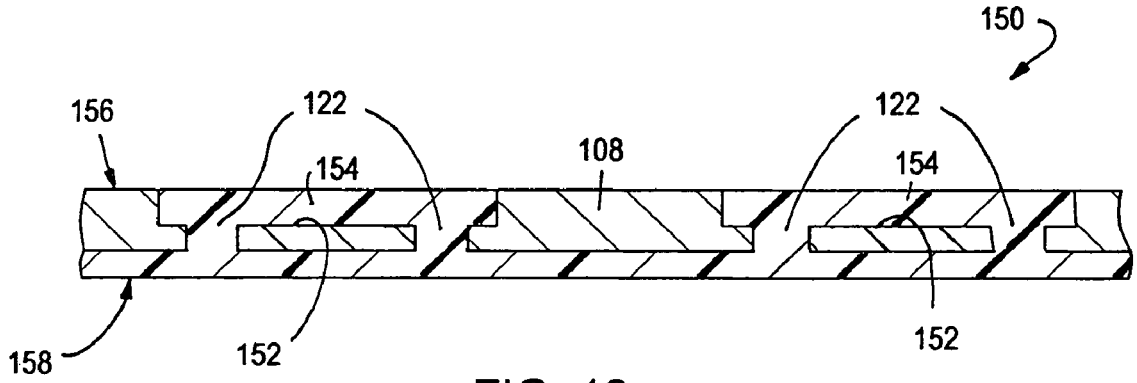
FIG. 19 is a fragmentary sectional view taken substantially along the line 19-19 in FIG. 18.

FIGS. 18 and 19 illustrate a valve 150 that is a modification to the valve 36 of FIGS. 12-14. Valve 150 includes a mounting ring 156 and a valve element 158. Adjacent pairs of opening enlarged portions 112 of through-openings 110 are joined by a channel 152 molded into ledge 108. The material of valve element 158 extends at 154 through channels 152 to join adjacent pairs of pegs 122. A similar modification could be made to the embodiment of FIG. 15.

Valve 36, 130, 140 or 150 is mounted within closure shell 34, in the illustrated embodiments of the disclosure, by being secured by snap fit within wall 56 and retained by bead 62 (FIG. 3). This mounting arrangement is exemplary, and other suitable arrangements could be employed.

Valves 36, 130, 140, 150 can be made in a two-step operation in which mounting rings 100, 134, 142, 156 are first molded, and the mounting rings are then placed in a suitable mold for molding valve elements 102, 132, 144, 158 onto the mounting ring in a suitable insert molding operation. However, and more preferably in accordance with the present disclosure, valves 36, 130, 140, 150 are molded in a single-step two-material molding operation. In such an operation, mounting rings 100, 134, 142, 156 are first molded in a suitably formed mold cavity. One or more of the mold sections that form the mold cavity then are moved or repositioned to form a second mold cavity in which dispensing valve element 102, 132, 144 or 158 is integrally molded onto the mounting ring. In either event, the dispensing valve exits the mold as a completed assembly, which greatly facilitates handling of the dispensing valve and automated assembly of the dispensing valve to a closure shell or other support structure. It also is noted that the dispensing valve, including the mounting ring and the valve element, forms an "engine" that can be employed in combination with dispensing closure shells of many differing geometries. Thus, a single dispensing valve engine can be employed in combination with dispensing closure shells for differing customers and/or applications.

As noted above, the materials of the mounting ring and the valve element are selected to achieve the desired results, including the ability of the first-molded mounting ring to withstand the molding and cure temperatures of the second-molded dispensing valve. In other words, when using the preferred sequential injection molding technique, the melt temperature or the softening temperature of the first-molded component, preferably the ring, is higher than the melt temperature of the second-molded component, preferably the valve element. The ring preferably is of relatively rigid thermoplastic or thermosetting resin construction, and the valve element preferably is of flexible resilient thermoplastic or thermosetting resin construction. Silicone, specifically LSR, a thermosetting resin, is preferred for the valve element. Thermoplastic elastomers, such as styrenic copolymers, such as SBS (styrene-butylene-styrene), SIBS (styrene-isobutylene-styrene), SEBS (styrene-ethylene-butylene-styrene) and SEPS (styrene-ethylene-propylene-styrene), could be used for the valve element. Thermoplastic resins such as polyphenol amide, polyphenol amine, polybutylene terephthalate, nylon and glass-filled polypropylene, can be used for the ring.

There thus have been disclosed a dispensing valve, a dispensing closure and a method of making a dispensing valve that fully achieve all of the objects and aims previously set forth. The disclosure has been presented in conjunction with several presently preferred embodiments of the dispensing valve, and a number of modifications and variations have been discussed. Other modifications and variations readily will suggest themselves to persons of ordinary skill in the art. The disclosure is intended to embrace all such modifications and variations as fall within the spirit and broad scope of the appended claims.

The invention claimed is:

1. A dispensing valve that includes:

an annular ring of relatively rigid molded plastic construction, and a flexible resilient valve element integrally molded onto said ring, said ring and said valve element having at least one mechanical interlock to secure said valve element to said ring as said valve element is molded onto said ring, said mechanical interlock including openings in an inner periphery of said annular ring and portions of said valve element molded into said openings, wherein said inner periphery of said ring includes an annular ledge, and wherein said openings are through-openings disposed in an angularly spaced array around said ledge, and wherein each of said openings includes an enlarged portion opening at one axially facing surface of said ledge and an ensmalled portion aligned with said enlarged portion and opening to a second axially facing surface of said ledge.

2. The valve set forth in claim 1 wherein at least some of said through-openings are interconnected by channels in said ledge and into which said valve element is molded.

3. The valve set forth in claim 1 wherein at least some of said enlarged portions are interconnected by channels in said one surface of said ledge and into which said valve element is molded.

4. The valve set forth in claim 1 wherein said valve element includes an annular flange in opposed engagement with said second axially facing surface of said ledge on said ring, and pegs integrally molded with said annular ledge extending through said ensmalled portions into said enlarged portions of said through-openings.

5. The valve set forth in claim 4 wherein at least some of said pegs are interconnected by valve element material extending through channels in said one surface of said ledge.

6. A dispensing valve that includes:

an annular ring of relatively rigid molded plastic construction, said ring including an outer periphery for securing said valve within a dispensing opening and an inner periphery that includes an annular ledge having an angularly spaced array of through-openings including enlarged portions, and a flexible resilient valve element molded onto said annular ledge, said valve element having an outer peripheral portion in engagement with said ledge on said ring and integral pegs extending into said enlarged portions of said through-openings to at least partially define at least one mechanical interlock to secure said valve element to said ring.

7. The valve set forth in claim 6 wherein at least some of said through-openings are interconnected by channels in said ledge and into which said valve element is molded.

8. The valve set forth in claim 6 wherein each of said through-openings includes an enlarged portion opening at one axially facing surface of said ledge and an ensmalled portion aligned with said enlarged portion and opening to a second axially facing surface of said ledge.

9. The valve set forth in claim 8 wherein at least one of said enlarged portions are interconnected by channels in said one surface of said ledge and into which said valve element is molded.

10. A dispensing closure that includes:

a base having a deck with a dispensing opening, and a dispensing valve that includes an annular ring of relatively rigid plastic construction having an outer periphery engaged with said deck to secure said valve within said dispensing opening and an inner periphery within said outer periphery, and a flexible resilient valve element integrally molded onto said ring and being mechanically connected to said ring by at least one mechanical interlock between said valve element and said inner periphery of said ring, said interlock including openings in said inner periphery of said annular ring and portions of said valve element molded into said openings as said valve element is molded onto said annular ring, wherein said inner periphery of said ring includes an annular ledge, and wherein said opening are through-openings disposed in an angularly spaced array around said ledge, and wherein each of said openings includes an enlarged portion opening at one axially facing surface of said ledge and an ensmalled portion aligned with said enlarged portion and opening to a second axially facing surface of said ledge.

11. The closure set forth in claim 10 wherein at least some of said through-openings are interconnected by channels in said ledge and into which said valve element is molded.

12. The closure set forth in claim 10 wherein at least some of said enlarged portions are interconnected by channels in said one surface of said ledge and into which said valve element is molded.

13. The closure set forth in claim 10 wherein said valve element includes an annular flange in opposed engagement with said second axially facing surface of said ledge on said ring, and pegs integrally molded with said flat annular ledge extending through said ensmalled portions into said enlarged portions of said through-openings.

14. The closure set forth in claim 13 wherein at least some of said pegs are interconnected by valve element material extending through channels in said one surface of said ledge.

15. The closure set forth in claim 10 wherein said base has a lid and a hinge of one-piece integrally molded construction with said base.

16. A dispensing closure that includes:

a base having a deck with a dispensing opening and a dispensing valve mounted within said dispensing opening, said dispensing valve including:

an annular ring of relatively rigid molded plastic construction, said ring including an outer periphery securing said valve within said dispensing opening and an inner periphery that includes an annular ledge having an angularly spaced array of through-openings including enlarged portions, and a flexible resilient valve element molded onto said annular ledge, said valve element having an outer peripheral portion in engagement with said ledge on said ring and integral pegs extending into said enlarged portions of said through-openings to define at least one mechanical interlock of said valve element to said ring.

17. The closure set forth in claim 16 wherein at least some of said through-openings are interconnected by channels in said ledge and into which said valve element is molded.

18. The closure set forth in claim 16 wherein each of said through-openings includes an enlarged portion opening at one axially facing surface of said ledge and an ensmalled portion aligned with said enlarged portion and opening to a second axially facing surface of said ledge.

19. The closure set forth in claim 18 wherein at least some of said enlarged portions are interconnected by channels in said one surface of said ledge and into which said valve element is molded.

* * * * *